US007222668B2

(12) United States Patent
Belshaw et al.

(10) Patent No.: US 7,222,668 B2
(45) Date of Patent: May 29, 2007

(54) SAMPLE EXTRACTION SYSTEM FOR BOREHOLES

(75) Inventors: Douglas James Belshaw, deceased, late of Georgetown (CA); by Jean Bruce Belshaw, legal representative, Georgetown (CA); Jamieson Edward Champ, Georgetown (CA); James Gerard Pianosi, Toronto (CA)

(73) Assignee: Solinst Canada Limited, Georgetown, Ontario (CA)

( * ) Notice: Subject to any disclaimer, the term of this patent is extended or adjusted under 35 U.S.C. 154(b) by 404 days.

(21) Appl. No.: 10/881,089

(22) Filed: Jul. 1, 2004

(65) Prior Publication Data

US 2004/0261992 A1 Dec. 30, 2004

Related U.S. Application Data

(63) Continuation-in-part of application No. 10/101,460, filed on Mar. 20, 2002, now Pat. No. 6,758,274.

(30) Foreign Application Priority Data

Mar. 20, 2001 (GB) ..... 0106771.9
Nov. 12, 2001 (GB) ..... 0127004.0

(51) Int. Cl.
*E21B 27/00* (2006.01)
*E21B 49/08* (2006.01)

(52) U.S. Cl. ..... 166/162; 166/264; 166/242.3; 175/59

(58) Field of Classification Search ..... 166/242.3, 166/264, 162; 175/59, 60; 138/115
See application file for complete search history.

(56) References Cited

U.S. PATENT DOCUMENTS 4,424,859 A * 1/1984 Sims et al. ..... 166/67
5,246,070 A * 9/1993 Greve et al. ..... 166/242.3
6,454,010 B1 * 9/2002 Thomas et al. ..... 166/369
6,564,831 B1 * 5/2003 Sanoner et al. ..... 138/115

* cited by examiner

*Primary Examiner*—Jennifer H. Gay
*Assistant Examiner*—Shane Bomar
(74) *Attorney, Agent, or Firm*—Anthony Asquith Corp.

(57) ABSTRACT

For use in drawing samples of e.g water from a well. The sampling pipe is formed as an extrusion in polyethylene. The profile includes three equi-spaced channels. The profile, being triangulated, is rigid and resistant to buckling, which allows the sampling pipe to be coiled for transport to the site. Sample-tubes, pumps, etc, can be inserted into the channels. The channels can be plugged for isolation of sampling ports at different depths.

21 Claims, 11 Drawing Sheets

FIG. 5
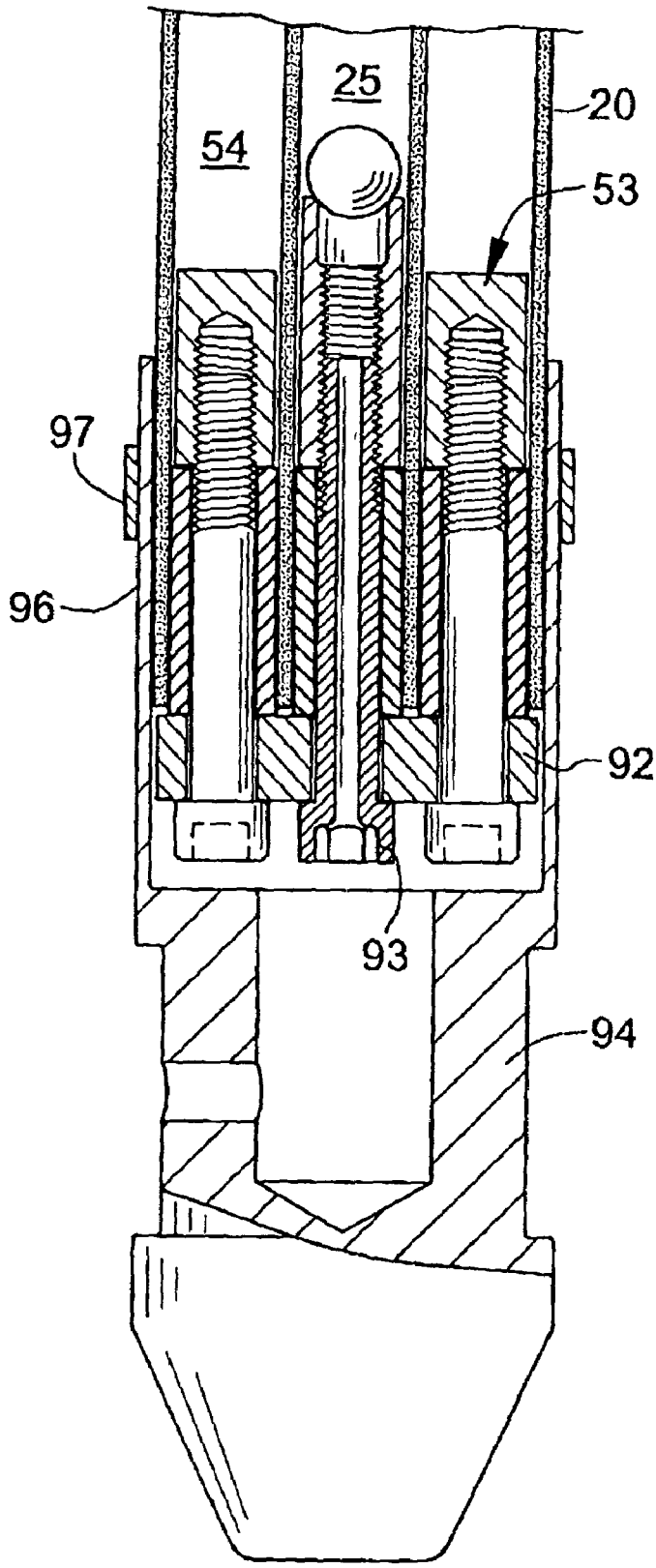
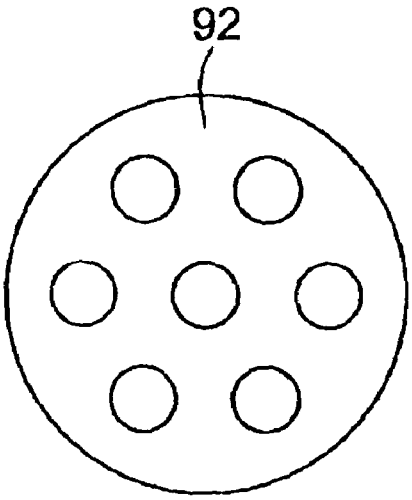
FIG. 12

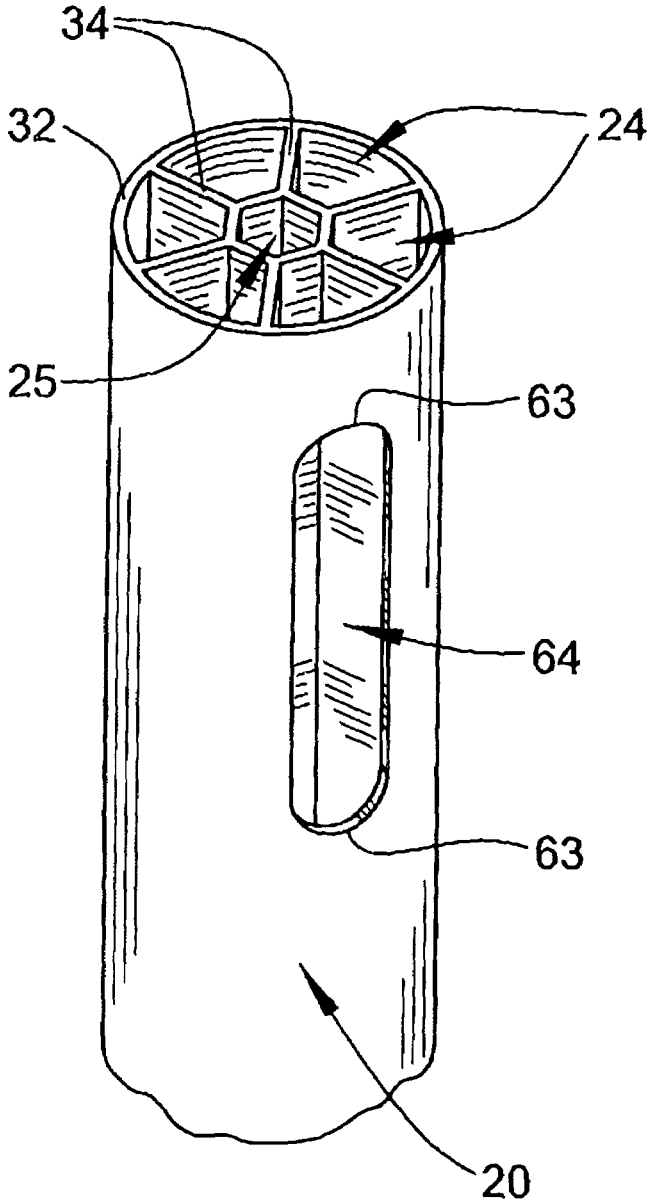
FIG. 8
FIG. 7
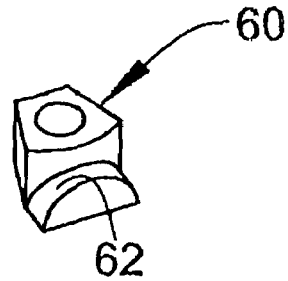
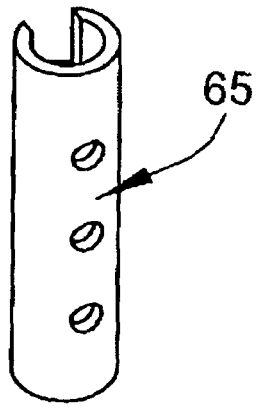
FIG. 9

Fig 15
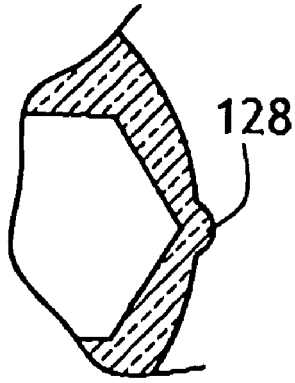
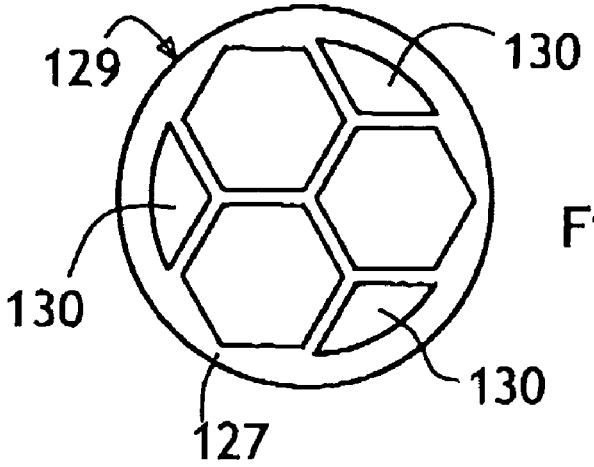
Fig 13
Fig 16
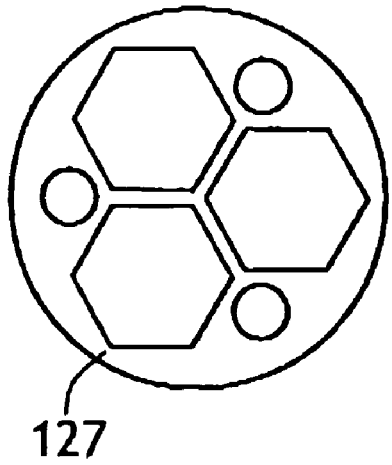

SAMPLE EXTRACTION SYSTEM FOR BOREHOLES

This is a Continuation-in-Part of U.S. patent application Ser. No. 10/101,460, filed 20 Mar. 2002, now U.S. Pat. No. 6,758,274, granted 06 Jul. 2004.

This invention relates to apparatus for taking samples, especially of water, from boreholes in the ground.

For taking samples from several different levels or depths within the same borehole, it is conventional to pass a length of continuous multi-channel (CMC) tubing down into the borehole. CMC tubing comprises a plastic (polyethylene) extrusion, in which a number of conduits, running the length of the CMC tubing, are isolated from each other by extruded internal walls. Typically, CMC tubing comprises six outer conduits, each having a pie-shaped cross-sectional profile, which surround a central conduit of hexagonal profile, making a total of seven conduits. Thus, samples can be taken from up to seven different depths.

In order to take a sample from the borehole from a particular depth, other than the lowermost depth, it is necessary to make a water-entry port in the side of the CMC tubing at that depth, and for the port to connect into one of the conduits, whereby water can pass, through the port, into that conduit.

One of the aspects that must be addressed by the designer, when using CMC tubing, lies in the seal that must be provided, to seal off the portion of the conduit that lies above and/or below the port. In most cases, in order to transport the sample to the surface, the conduit must be pressurised (from the surface), and the seal in the conduit must be able to withstand the pressure involved, without becoming dislodged and sliding lengthwise along the conduit.

Anchoring the seal into the conduit, so the seal does not slide along the conduit, is all the more difficult because the CMC tubing is extruded in polyethylene, which has a low coefficient of friction. Also, the CMC tubing is not very rigid, whereby the tubing can become distorted if a seal is mechanically forced into one of the conduits too tightly. Furthermore, extruding polyethylene does not produce very accurately repeatable profiles.

Thus, the designer of the seals for the conduits in CMC tubing must have it in mind that the conduits are characterised by: low friction; walls that lack solidity; a non-round, angular shape; and only moderate precision.

One of the ways in which the conduit seals have traditionally been made is by filling the segment-shaped conduit with glue, or by glueing a plug into the conduit. However, the conduit seals are (usually) made in-situ, i.e in the field, at the site of the well into which the CMC tubing is to be installed. The usual procedure is that the CMC tubing is laid out (horizontally) on the ground, for the various ports, packers, seals, etc to be made and assembled, at the appropriate locations along the horizontal length of the tubing (i.e along what will be the vertical depth of the tubing when it is installed in the borehole).

While it is easy to manufacture properly effective seals, with quality-control inspection to ensure high standards, in a factory, it is all too possible for field-installed glue-based seals to be inadequate. It is hardly practical to field-test the seals for pressure tightness, and what might look to the installation technician to be a sound seal might be blown out by the first application of pressure to the conduit. And the technician might not even know that the seal had been blown out, if the seal moved in a way that left it still possible to extract a sample of water from the borehole. Consequently, even if all the glue-based seals were perfect. It would not be possible to place much reliance on that being so. Sometimes, for example when assessing the location of a contaminant spill in groundwater, the results of the sampling are examined by a tribunal, which must be assured that the samples have indeed come from the designated depth.

The invention is a development of the technologies depicted in patent publication CA-2,260,587.

LIST OF DRAWINGS

FIG. 1 is a diagram of a borehole or well, in the ground, in which a sample monitoring and extraction system has been installed, and which embodies the use of the present invention.

FIG. 2*a* is a pictorial view of a rubber grommet as used in the invention.

FIG. 2*b* is a pictorial view of another rubber grommet as used in the invention.

FIGS. 3*a*,3*b* are upper and lower close-ups, in cross-section, of a port zone of the apparatus shown in FIG. 1.

FIG. 5 is a close-up, in cross-section, of a bottom zone of the apparatus shown in FIG. 1.

FIG. 7 is a close-up pictorial view of one of the components of FIG. 6.

FIG. 8 is a pictorial view of a port zone of a length of CMC tubing, as used in FIG. 6.

FIG. 9 is a close-up pictorial view of another of the components of FIG. 6.

FIG. 12 is a plan view of a corresponding base end-retainer, as used in FIG. 5.

FIG. 13 is a profile of another form of CMC tubing.

FIG. 15 is a cross-section of a portion of a CMC sampling-pipe.

FIGS. 16,17,18,19,20 are cross-sections of other three-channel CMC sampling pipes.

DESCRIPTION OF PREFERRED EMBODIMENTS

Figure 1:
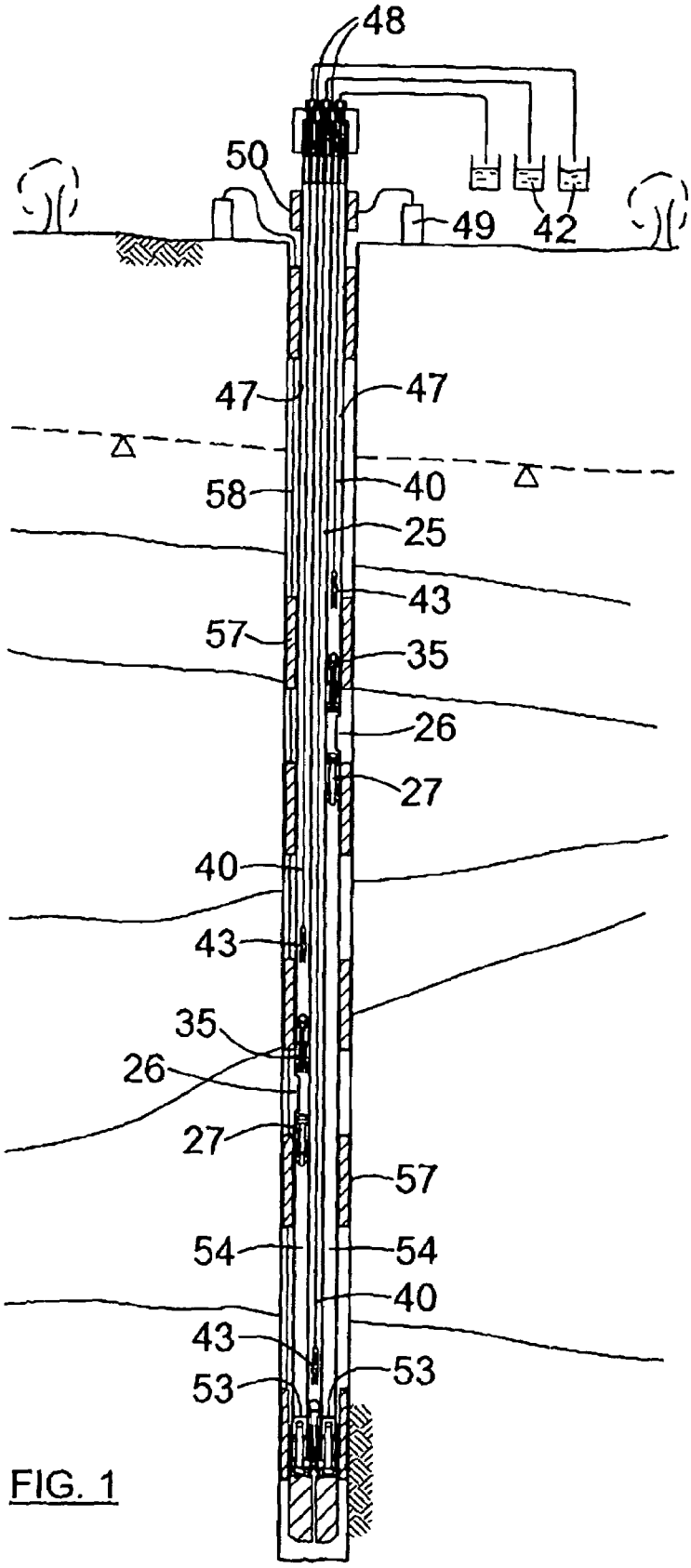

In the drawings, a length 20 of continuous multi-conduit (CMC) tubing extends from top to bottom of a borehole 23. Typically, the borehole may be e.g eight or ten cm in diameter, and the borehole may be up to a hundred meters deep. The CMC tubing as depicted herein has an outer diameter of 4.32 cm, and a wall thickness of a little under 1 mm.

The CMC tubing 20 is an extrusion in polyethylene (the extruded profile of which is shown in FIG. 8), the extrusion having an outside wall 32 and internal walls 34. The walls define six outer conduits 24 and one central conduit 25. In cross-section, the central conduit 25 is hexagonal, and the outer conduits 24 are pie-shaped segments.

The seven conduits may be used for extracting samples from seven different depths of the borehole. The central conduit 25 is used for extracting samples from the bottom end of the CMC tubing, i.e from the bottom of the borehole, and the six outer conduits 24 for extracting samples from six intermediate depths.

Alternatively, the seven conduits may be used for different purposes. For example, four of the conduits may be used for extracting samples (in which case those four conduits need to be able to be pressurised). The other three conduits may be used for monitoring, in which a sensor, for example a water-level sensor, is lowered down the conduit from the surface, and in that case it is often not required to seal the conduit. Quite often, it is required to take samples and to carry out monitoring with sensors at the one designated depth, in which case one seated (pressurisable) sampling conduit and one non-sealed monitoring conduit may be provided at that depth.

It is usually known beforehand what work is to be done with the seven conduits, and different fittings for the conduits, to suit the different tasks, can be specified and provided.

The task of preparing the CMC tubing for use as a downhole sampling means is done with the full (continuous) length of the CMC tubing laid out on the ground, at the surface, prior to insertion thereof into the borehole. Six intermediate depths are selected. In respect of each depth, a port-hole 26 is out in the polyethylene outer wall of the CMC tubing, to give access to an appropriate one of the conduits 24, and to provide a port through which the sample of water can pass into the conduit.

FIG. 1 shows three of the conduits, which communicate with respective ports formed at three depths. At each intermediate port, a below-port-plug-assembly 27 is inserted, through the port-hole 26 cut in the outer wall of the CMC tubing, into the conduit 24, and is placed, in the conduit, at a point just below the cut port-hole 26. The below-port-plug-assembly 27 (see FIG. 3*b*) comprises a nut 28, a bolt 29 (both of stainless steel), a grommet 30 of rubber, and a stainless-steel (or plastic) washer 31. The head of the bolt 29 is accessible from the port-hole 26. When the bolt 29 is tightened (e.g with an alien key) the rubber grommet 30 is compressed, and bulges outwards, thereby making sealing contact with the outer wall 32 and the dividing walls 34 of the CMC tubing.

Alternatively, the nut 28 may be a plastic moulding. Also, the bolt 29 may be a plastic moulding. The material of the grommet 30 should be rubber or other elastomeric material that is capable of bulging and swelling laterally when subjected to an axial compression, preferably resiliently. The material should also be stable and inert with respect to the water, bearing in mind the possibility that certain chemicals might be encountered in the water.

Figure 2A:
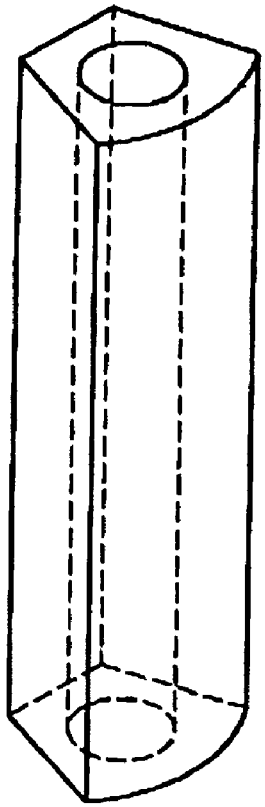
Figure 2B:
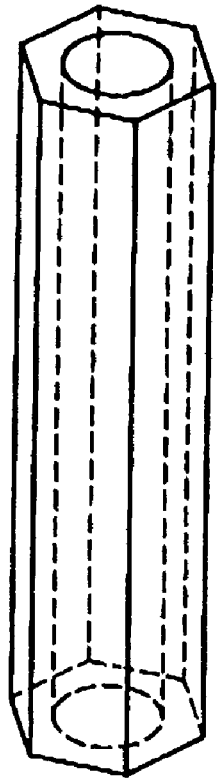

The grommet 30 is made to a cross-section that is nominally slightly smaller than the pie-shaped cross-section of the conduit 24. The pie-shaped grommet, for the outer conduits, is shown in FIG. 2*a* and the hexagonal grommet, for the central conduit, in FIG. 2*b*. These grommets are about four cm long. It should be noted that the CMC tubing as produced by the extrusion process is subject to moderate tolerances as to the exact dimensions of the conduits, and the nut 28 and grommet 30 should be sized to take account of the tolerance and ensure easy fitment into the conduit. The grommet 30 conforms to the nominal cross-sectional shape and configuration of the interior of the conduit, but, as manufactured, is nominally marginally smaller, all around, than the conduit.

The corners of the CMC tubing, where the walls meet, can be quite sharp, and the grommet, when installed, must fit tightly into the corners. The designer may arrange for the external corners of the grommet to fit a little more tightly into the corners of the conduit than the sides of the grommet fit against the main flanks of the wall surfaces. The CMC tubing conduits 24 have a cross-sectional area, typically, of 1½ sq cm, and the grommet should be shaped to fit the cross-sectional shape of the conduit, but with a margin of, typically, ½ mm between the outer surfaces of the rubber grommet and the walls 32,34 that define the conduit. As mentioned, the grommet may be a little tighter in the corners.

The nut 28 should be of such a fit in the conduit that the nut is constrained by the walls of the conduit against turning, when the bolt 29 is being turned. The marginal clearance or gap between the nut 28 and the walls of the conduit also should be small enough to prevent the elastomeric grommet from bulging into the gap. The metal (or plastic) washer 31 also should be shaped to conform to the size and shape of the inside cross-section of the conduit, and again the marginal gap between the shaped washer 31 and the walls of the conduit should be small enough to prevent the grommet from bulging into the gap. Again, a gap of about ½ mm should suffice.

The rubber grommet 30 should be long enough to ensure a good sealing contact with the walls of the conduit. Die grommet should also be arranged to close down into sealing contact with the bolt 29. Good results are achieved when the grommet has an axial length of three or four cm. The grommet 30 (and the nut 28) should not be made longer than necessary to ensure a good seal, given that the plug assembly has to be inserted into the conduit through the port-hole 26.

Figure 3A:
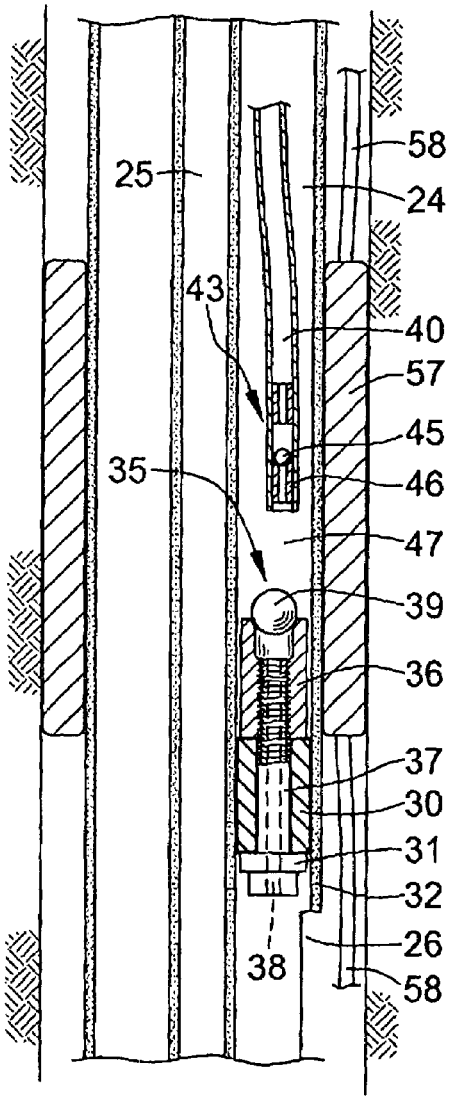
Figure 3B:
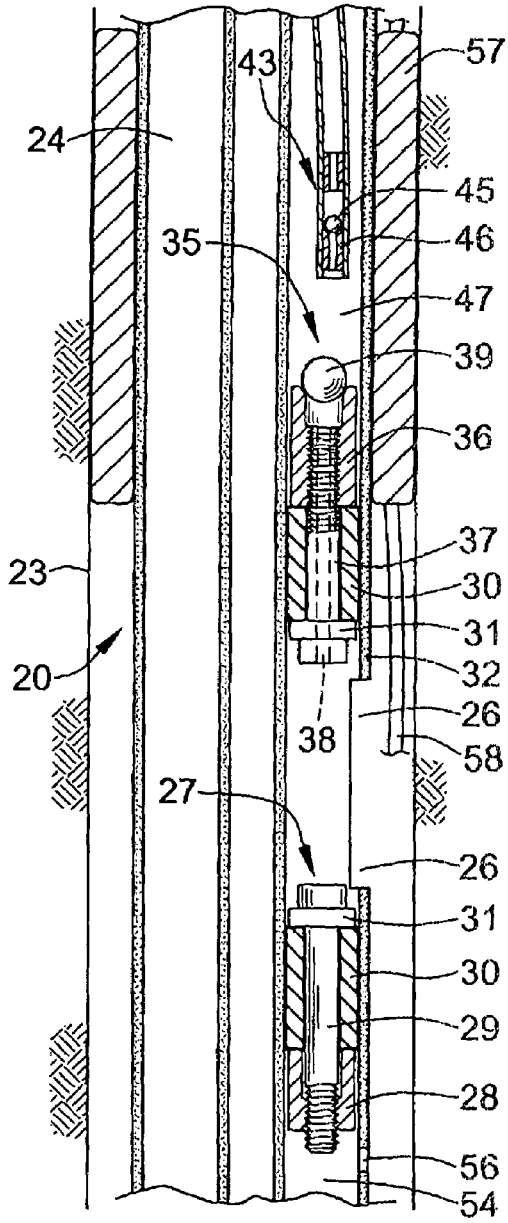

In FIGS. 3*a*,3*b*, an above-port-plug-assembly 35 is placed above the port-hole 26, in the conduit 24. The above-port-plug-assembly is similar to the below-port-plug-assembly 27, in having a rubber grommet 30 and a nut 36 and bolt 37, except that the bolt 37 of the above-port-plug-assembly includes a through-hole 38. The through-hole 38 permits water to pass upwards through the above-port-plug-assembly 35. The nut 36 is formed with a conical socket, on top, and a ball 39 resides in the socket, whereby water can pass upwards but not downwards through the above-port-plug-assembly 35.

The ball 39 may be lighter than water. In that case, the ball floats upwards, away from the socket, and so, if pressure conditions in the borehole should change, water can flow either upwards or downwards past the ball, and pressures can be equalised. When taking samples, the conduit 24 above the port becomes pressurised, and the resulting sudden downwards movement of water is enough to drive the floatable ball downwards against the socket. Of course, the designer must provide some means in the conduit for preventing the light ball from floating away.

Alternatively, the ball may be heavy. In that case, if a higher pressure were to develop in the water in the conduit above the ball, between sample-taking sessions, that would not be equalised, but at least the bail-valve is self-closing in the absence of pressure from below.

A sample-extraction-pipe 40 resides in the conduit 24, and extends down, from the surface, to a point that is just above the above-port-plug-assembly 35. The top end of the pipe 40 connects with a receptacle 42, at the surface, for receiving the sample. The bottom end of the pipe 40 is fitted with a foot-valve-assembly 43. The assembly 43 includes a ball 45, which seals against a conical socket in the lower-insert 46. Thus, the foot-valve-assembly 43 allows water to pass up into the pipe 40, and then prevents the water from passing down out of the pipe.

To extract a sample of water, and to pump the sample to the surface, first the space 47 above the above-port-plug-assembly 35 is allowed to fill with water to its natural level. Then, the space 47 is pressurised, from above. This forces the water in the space 47 to pass up, through the foot-valve-assembly 43, into the pipe 40. When the pressure is released, more water from the port now can enter the space 47, while the water that has already entered the pipe 40 remains stationary. Then, the space 47 is pressurised again, then released again, and so on, until a flow of sample water emerges into the receptacle 42 (FIG. 1).

Figure 4:
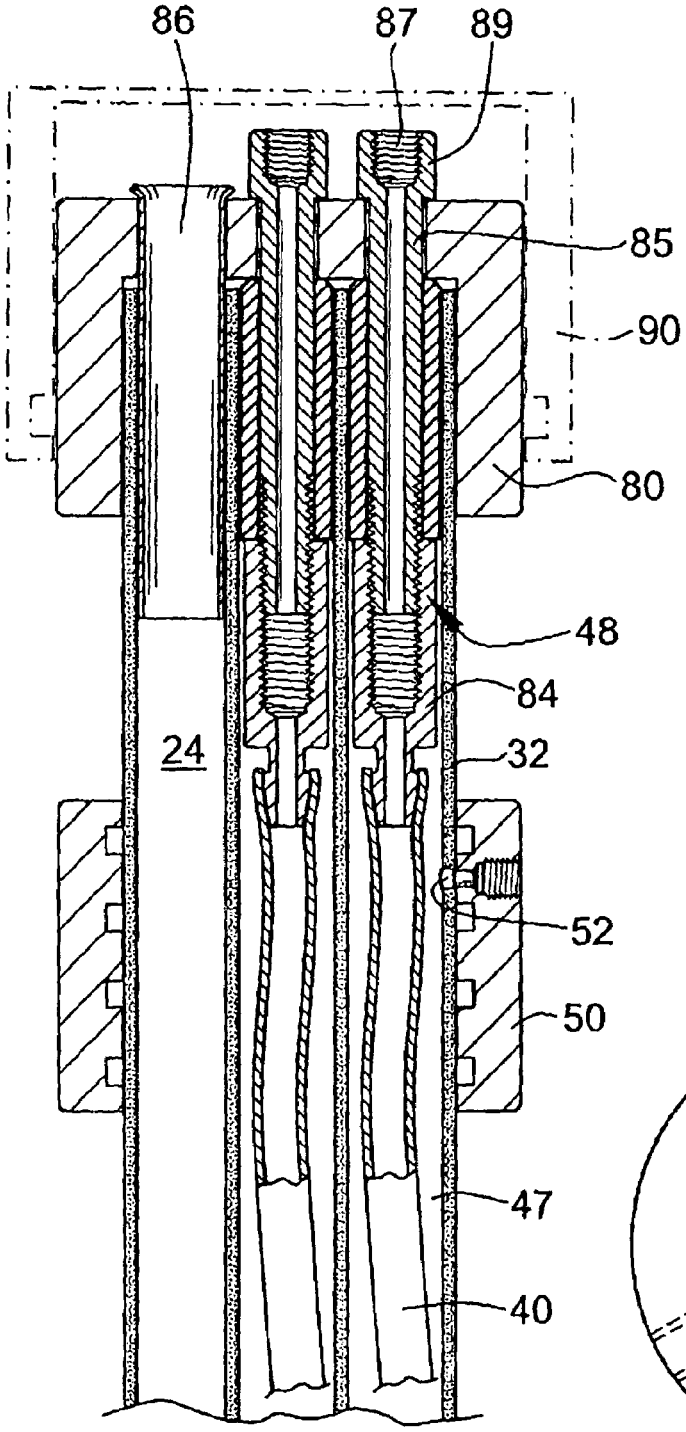
FIG. 4 is a close-up, in cross-section, of a top zone of the apparatus shown in FIG. 1.

FIG. 4 shows the structure of the apparatus that is left protruding up out of the top of the borehole. At the surface, the spaces 47 respective to the six conduits 24 are plugged by means of respective top-plug-assemblies 48. These have e.g push-on barb-connectors, as shown, for connecting the pipes 40 into the respective top-plug-assemblies, whereby the contents of the pipes can pass up through the top-plug-assemblies, and into the receptacles 42.

Pressure from a pressure-supply-unit 49 (FIG. 1) is fed into the spaces 47 above the ports in the respective conduits via a pressurisation-ring 50 (FIG. 4), through respective holes 52 formed in the outer-walls 32 of the conduits. The pressurisation-ring 50 may be arranged such that the spaces 47 can all be pressurised together, i.e simultaneously, or may be arranged, as shown, such that the spaces can be pressurised one at a time. The pressure-supply-unit 49 may include a nitrogen bottle, air compressor, or the like, with suitable operating controls.

At the very bottom of the length of CMC tubing, the conduits 24 preferably should be plugged, and FIG. 5 shows the respective bottom-plug-assemblies 53 that are provided for that purpose.

In respect of each of the six outer conduits 24, the below-port-portion 54 of the conduit 24 that lies below the port, when the port and plug-assemblies are being made up, at the ground surface, is full of air. If this air is left in the conduit, the CMC tubing might be too buoyant. Therefore, an air-hole 56 should be provided in the wall of the conduit, below the below-port-plug-assembly 27, whereby air can escape and water can enter and fill the portion 54 of the conduit.

The central conduit 25 is used for extracting samples from the very bottom of the CMC tubing. So, in respect of the central conduit 25, there is no below-port-plug-assembly, and no bottom-plug-assembly.

For the purpose of conveying the samples to the surface, as an alternative to the pressure apply-release procedure described, the pipe 40, with its captive ball 45, may be moved (rapidly) up/down in the conduit. This can be done from the surface, by hand if desired, or by the use of a suitable automatic means. Pumping occurs because the pipe 40 is jerked up and down vigorously enough to seat and unseat, respectively, the ball 45, whereby a volume of water is admitted into the pipe 40 with each downstroke, causing a flow to appear at the receptacle 42. Such pumping out of the sample may be termed single-valve pumping, and in that case no valve ball 39 is needed, and the conduit space 47 can be left open to the port. However, double-valve pumping, involving the two balls 39 and 45, is more versatile.

It is emphasised that the system of plugging the conduits as described herein is advantageous from the standpoint of double-valve pumping. Traditionally, double-valve pumping has required that two tubes be passed down from the surface—one tube to convey pressurised fluid down to the sampling point, and the other to conduct the sample to the surface. Thus, a traditional double-valve apparatus, which had the capacity to take samples from several depths, was beset by many pipes and tubes. The present system enables the conduit itself to be pressurised, and thus to replace the pressure pipe, whereby only the sample-collection-pipe now passes down to the sampling point, as a separate physical structure.

Preferably, the ports are provided with respective screens (not shown), of mesh, sand, etc, to filter out particles from entering the ports.

In most cases, it is required to isolate the sampling ports from each other, and packers 57 should be placed on the length 20 of CMC tubing, above and below each port. The packers fill the annular space between the CMC tubing and the borehole. The packers 57 may be of the inflatable/deflatable type, in which the packers are filled with water, from the surface, after the CMC tubing has been lowered to its working position in the borehole, via inflation tubes 58. In that case, it is usually acceptable for all the packers to be inflated simultaneously and deflated simultaneously. Alternatively, the packers may be more permanent, in which case packers of bentonite between the sampling ports prevent movement of water between the levels, and screens of sand are provided around the ports themselves.

The following points should be noted, regarding the continuous multi-conduit tubing.

1. The CMC tubing is intended to be provided as one single length of CMC tubing, without joints, over the whole depth of the borehole; so, preferably, for transport, the CMC tubing should be flexible enough to be capable of being rolled into a coil of less than about three meters diameter, without kinking or buckling, and preferably less than 1½ meters.
2. The seven-conduit CMC tubing as described is structurally quite rigid, from the cross-sectional standpoint. The radial walls between the conduits serve as spokes, which support the outer wall against buckling and collapsing.
3. It should be noted also that the packers 57 apply a squeezing stress to the CMC tubing, and the CMC tubing must be strong enough not to collapse when the packer is inflated. Again, the spokes support the outer cylindrical wall against such stresses.
4. When the elastic grommet is tightened in the conduits, the walls of the conduits must be strong and rigid enough to withstand the induced stresses, to enable the seal to be made.
5. The plug assembly is subject to pressure differentials, during operation. The walls of the conduit must be rigid enough to enable the plug to grip tightly enough that the pressure does not cause the plug to slip and move relative to the conduit.
6. CMC tubing of other sizes and configurations may be used, but it is noted that the four-cm-diameter, seven-conduit, CMC tubing meets the above criteria very well. Seven-conduit CMC tubing of larger diameter cannot be coiled so tightly, without kinking. CMC tubing having fewer conduits, and therefore fewer spokes, should be regarded as less likely to be able to meet the strength and rigidity requirements.
7. It is possible to use more than one length of CMC tubing in a borehole, disposed side by side, in cases where the resulting difficulty in arranging the packers can be met. However, attempting to make sealed joints between two lengths of CMC tubing placed end-to-end is contra-indicated.

8. The CMC tubing need not be circular. However, with other cross-sectional shapes, the packers are difficult to arrange, and the tendency for the CMC tubing to buckle might be increased.

The following points should be noted, regarding the elastomeric grommet.

1. As mentioned, the grommets are of elastomeric material. Although such materials are commonly referred to as rubber, in fact natural rubber itself would not be preferred. One preferred material is SANTOPRENE™, a thermoplastic polymer. This material has good mouldability, on a quantity-production basis; It has good elasticity characteristics, in terms of its ability to sustain an elastically-distorted shape without taking a permanent set; and it substantially does not release any chemicals into water, which might contaminate sample results.
2. The grommet material should be resilient enough to allow the material to bulge easily when compressed, without tearing. SANTOPRENE™ with a durometer hardness of 74 has proved satisfactory.
3. The grommets may be moulded. Or, since they are of constant cross-section along their length, extrusion may be considered, as the method for manufacturing the grommets. The central through-hole of the grommets can be produced in the extrusion.

As described in relation to FIGS. 3*a*,3*b*, the plug-assemblies are sealed into the interiors of the sectors by compressing the rubber grommet, and the friction of the contact between the rubber plug and the interior wall of the sector serves as a mechanical lock, for preventing the plug-assembly from slipping along the sector. But sometimes, this friction might not be enough to stop the plug-assembly slipping; this can arise when, for example, the water-table is very deep, such that a large pressure must be applied to force the water sample to the surface, and this pressure is felt by the plug-assembly.

In FIGS. 3*a*,3*b*, the plug-assembly was locked into the conduit only by the friction caused by compressing the rubber against the walls of the conduit. The arrangement of FIG. 6 addresses the problem of that friction not being enough, by engaging a member 60 (which corresponds to the washer designated 31 in FIGS. 3*a*,3*b*) in mechanical abutment with the cut-out port-aperture in the wall of the CMT tubing. FIG. 7 shows the shape of the member 60. A semi-circular ledge 62 on the member 60 engages a complementary end-form 63 of the cut aperture 64 (FIG. 8).

Figure 6:
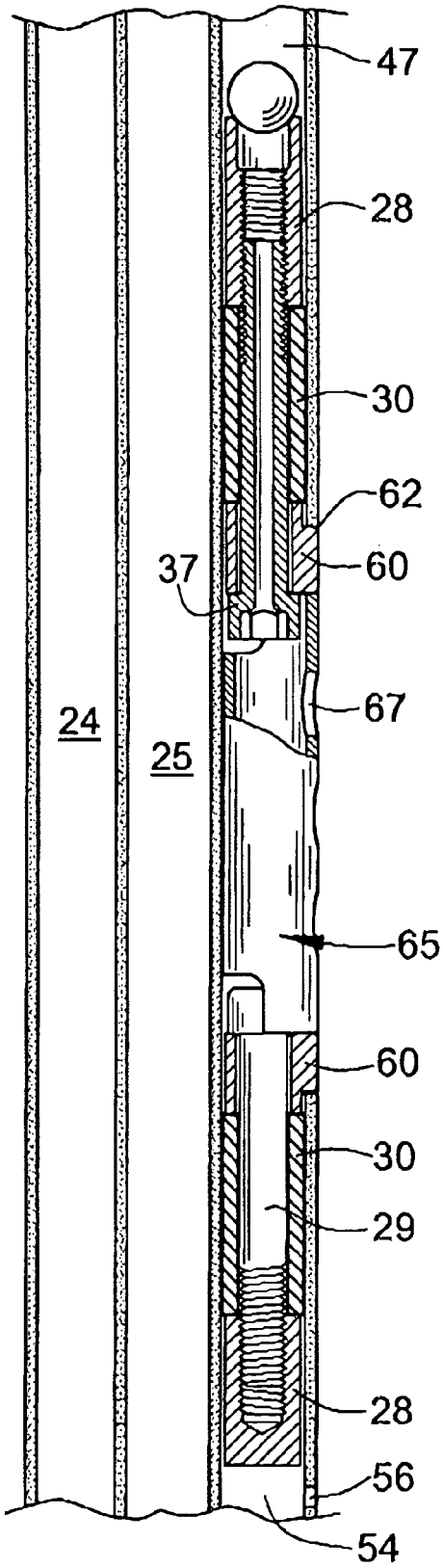
FIG. 6 is a close-up, in cross-section, of a port zone of a variation of the apparatus of FIG. 3.

As may be seen in FIG. 6, both the above-port-plug-assembly and the below-port-plug-assembly are provided with the members 60, and the two members 60 engage one each and 63 of the aperture 64. The engagement between the member 60 and the end 63 of the aperture, provides mechanical assistance to aid in preventing the plug assembly from moving relative to the conduit. However, the said engagement, in itself, of the upper member 60 with the upper end of the aperture only prevents the above-port-plug-assembly from moving upwards. Similarly, the engagement of the lower member 60 with the lower end of the aperture only prevents the below-port-plug-assembly from moving downwards.

In order to prevent the above-port-plug-assembly from being blown downwards by the pressure in the portion 47 of the conduit, a spacer 65 is fitted between the two members 60. The spacer 65 (shown by itself in FIG. 9) is inserted between the two members 60 after both plug assemblies have been inserted into the aperture, and fully assembled and tightened into the conduit. The spacer 65 is basically a length of (plastic) tubing, having cut-outs at the ends to allow the ends to clear the heads of the bolts 29 and 37, and to abut the respective members 60. The spacer has holes 67 to admit water from the borehole into the port.

The provision of the spacer 65 enables the mechanical abutment of the lower one of the members 60 against the lower one of the ends 63 of the aperture to assist in preventing the above-port-plug-assembly from being blown downwards. Now, the security with which the plug-assemblies are held in the conduits, with the use of the member 60 and the spacer 65, is enough that the tribunal can be assured that the plug-assemblies must indeed be properly in place when readings are taken, with an assurance-margin that allows even for abusively high pressures to be applied to the conduit.

Figure 10:
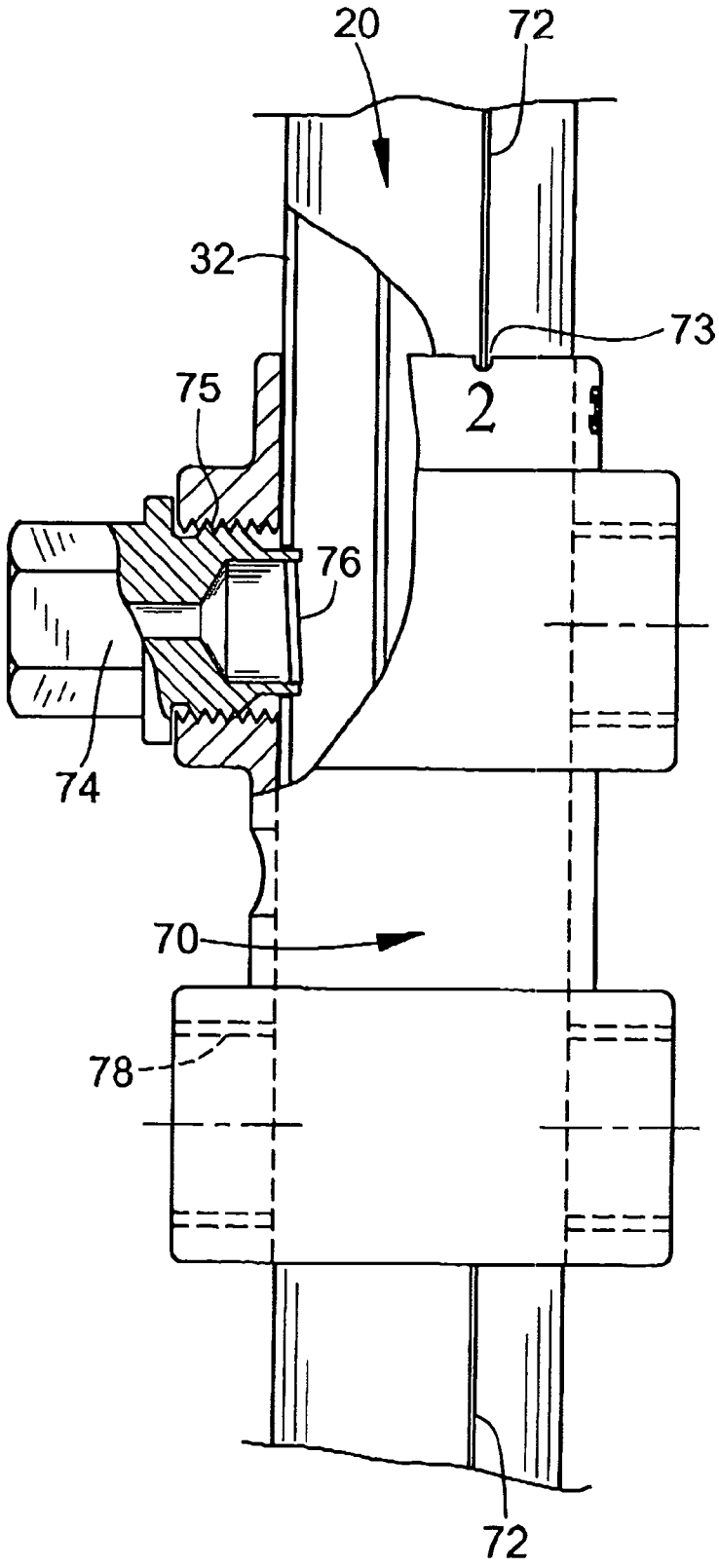
FIG. 10 is a close-up, in cross-section, showing the manner of use of a template-tool.

It will be understood that the spacer 65 can function properly only if the distance apart of the ends 63 of the aperture 64 are very accurately located. This accuracy can be assured by the use of the template-tool 70 (FIG. 10).

In use, the technician slides the template-tool 70 along the CMC tubing to the location of the port. The technician then orientates the tool on the CMC tubing to the correct one of the six outer conduits in which the aperture is to be made. To assist in identifying the correct one of the conduits, the tubing extrusion includes a small ridge (or it may be a groove) 72. The tool has six notches 73, each carrying a number, and the technician aligns the appropriately numbered one of the notches 73 with the ridge 72.

With the tool correctly located, a cutter 74 is inserted into a threaded hole 75 in the body of the tool. The cutter includes a protruding tubular nose, which has sharp edges. As the cutter is rotated, it cuts a hole through the outer wall of the CMC tubing. The removed disc 76 of polyethylene is retained in the interior of the cutter (it is preferred that the disc should not be allowed to fall into, and remain in, the conduit). The disc may be poked out of the cutter when the cutter is later removed from the tool. By this manner of cutting the hole, the hole is assured of being accurately placed, of accurate diameter, and burr-free.

Without moving the body of the template-tool 70, the technician then places the cutter 74 in the lower threaded hole 78, and produces another accurate, burr-free hole in the conduit outer wall. The two holes are spaced apart exactly at the distance as dictated by the dimensions of the tool 70. Next, shears or a knife may be used to interpolate the aperture between the two holes, to produce the shape of aperture as shown in FIG. 8. No doubt the edges of the aperture between the two holes will not be so accurately done as the holes themselves, but it is the holes that must be accurate in order for the spacer 65 to function effectively.

By the use of the template-tool 70, the designer can be sure that the apertures 64 are always made properly, and positioned properly. Even though the task of cutting the apertures for the ports is done in the field, even a clumsy operator can hardly fail to do all the apertures properly, time after time. The hole 56 in the outside wall of the CMC tubing, for venting the portion of the conduit below the sampling port, can also be done using the template-tool, if the template hole therefore is provided in a suitable downwards extension, in a modified version of the tool.

It can be useful to use a torque wrench to tighten the bolts in each of the plugs. This prevents over-tightening, and thus over-expansion of the plugs. Over-expansion might cause the segment-shape of the cross-sectional profile of the conduit to distort at the location of the plugs. A torque wrench makes sure the expansion of the rubber adjusts itself to give a constant and repeatable seal pressure against the conduit walls.

Figure 11:
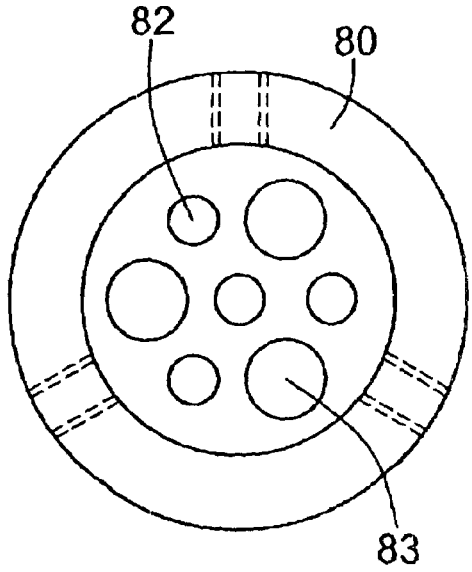
FIG. 11 is a plan view of top end-retainer, as used in FIG. 4.

Returning now to FIG. 4, which shows the components at the top of the CMC tubing, one of those components is an end-retainer 80, which fits over the top end of the CMC tubing. FIG. 11 is a plan view of the end-retainer. The end-retainer has seven holes, corresponding to the seven conduits. In this case, three of the outer conduits and the central conduit are to be used for collecting samples, and need to be pressurised, and these conduits are provided with small holes 82. The other three outer conduits are to be used for monitoring, and do not need to be pressurised, and these are provided with large holes 83. Thus, probes, sensors, etc, can be lowered down through the large holes. The small holes are appropriate where the conduit is to be plugged, In the case of the conduits that are to be plugged, the components are assembled by first securing the sample collection pipe 40 (with its foot-valve-assembly 43 at the remote end thereof) to the barb-connector on the bottom of the nut 84. Then, the pipe 40, which has previously been cut to length, is inserted into the appropriate one of the conduits, until the foot-valve-assembly lies a few cm above the above-port-plug-assembly of the port of that conduit.

All four of the top-plug-assemblies are bolted into the end-retainer 80, and are inserted into their conduits, and lie in position in the ends of the conduits, with the skirt of the end-retainer 80 overlying the top end of the CMC tubing. At this time, the hollow bolts 85 are loose, whereby the grubber grommets 30 remain un-compressed, and the assemblies can slide along the conduits, and into position. Then, the four bolts 85 can be tightened, which compresses the grommets, and locks the four assemblies into the CMC tubing.

Sleeves 86 are inserted into the large holes 83. These sleeves, though cylindrical, engage the insides of the walls of the three non-pressurisable conduits, and serve to prevent those walls from collapsing. The plastic CMC tubing walls can distort if too much pressure is applied, the sleeves 86 prevent this, whereby the bolts 85 can be tightened very securely. To complete the security with which the top plug-assemblies 48 are held into the CMT tubing, three screws (not shown) act radially, through the skirt of the end-retainer 80, to clamp onto the outer wails of the CMC tubing.

It should be noted that the rubber grommets as described herein can distort considerably. Thus, a grommet that has an as-manufactured axial length of, say, four cm, may be compressed, in the plug assembly, down to three cm or even two cm. (The designer must see to it that the screw threads have enough axial length to accommodate this movement.) The profile of the conduit containing the grommet also will expand, and the walls of the conduit can be expected to move out typically about one mm. It is recognised that the expanding-grommet plug-assemblies as described herein will accommodate this lack of rigidity, and yet provide highly reliable seals. The sleeves 86 are important in this respect. As mentioned, if the un-plugged conduits were just left open, their tendency to collapse would limit the extent to which the grommets in the plugged conduits could be tightened.

The hollow bolts 85 are provided with threaded ports 87, into which pipes can be affixed, for transferring collected liquids to the receptacles 42. The heads 89 of the bolts 85 are hexagonal externally; this may be contrasted with the hollow bolts 37 used in the above-port-plug-assemblies 35, where the hexagon was internal (to enable the bolt 37 to be turned, by the use of an alien key, from the port aperture 64). The pipes leading to the receptacles 42 can be removed when not actually being used, and a protective cap 90 then placed over the top of the assembly.

It may be noted that the top end-retainer 80 corresponds to the nuts 31 (or the members 60), as being the component against which the compression of the grommet is reacted. The fact that the end-retainer serves that function for four of the plug-assemblies 48 means that, when one of the conduits is being pressurised, four plug-assemblies are available to resist the assembly from being blown out of the top of the tubing. Of course, if all four conduits were pressurised simultaneously, the advantage of that would be negated, but in practice the conduits are hardly ever pressurised simultaneously.

In fact, the pressure that can be applied to any one of the conduits depends on the number of conduits that are plugged, and the number of those that are being pressurised at the same time. Thus, the in-the-field user of the system may be provided with a table showing what maximum pressures can be applied to which conduits, under the various configurations.

The pressurisable conduits are pressurised via the pressurisation ring 50, through the holes 52 that admit the pressure fluid into the conduit. One of the holes 52 is formed right through its outer conduit, and into the central conduit, whereby the central conduit is pressurised at the same time as that outer conduit. If it is desired that even the central conduit, too, should only be pressurised by itself, the porting arrangement would be quite complicated, and that is not necessary in most cases.

The pressurisation ring 50, as shown, provides three independent pressure sources. When all seven conduits are to be pressurisable, a single ring, with six pressure ports (the port for the central conduit is combined with one of the ports for the outside conduits), might be provided, but likely would not be satisfactory, because the polyethylene CMC tubing can bend enough, over that length, for one or two of the O-ring seals to lose contact, and leak. In fact, it may be preferred to provide mechanically-independent pressurisation rings, one for each pressure port, for this reason.

In some instances, it may be preferred, not to pressurise the space 47 of the conduit in order to pump the sample out, but rather to provide a down-pipe, alongside the pipe 40, to conduct the pumping pressure down to the port, from the surface. In that case, the piping arrangements at the top end of the tubing are again quite complex, but that can be done if preferred.

Attention is again directed to the bottom end of the CMC tubing, as shown in FIG. 5. Here, the plug-assemblies 53 (i.e all seven of the plug assemblies) are clamped to a common bottom end-retainer 92, which is shown in plan in FIG. 12. At the bottom, only the bolt 93 for the central conduit is hollow, and the rest of the conduits are simply plugged. This mechanical linking together of the plugs, via the bottom end-retainer, means that the bottom pug-assemblies are very securely fixed to the CMC tubing.

An end cap 94 fits over the bottom end of the CMC tubing. The bottom end cap 94 is heavy, to aid in sinking the tubing to tho bottom of the well. The end cap 94 incorporates the sample-collection port for the central conduit. The end cap may be provided with a hold-down plate (not shown), which is a flat disc bolted to the foot of the end cap. In cases where the borehole is to be back-filled with sand or other material, after installation, the sand rests on the flat disc, and anchors the disc down, thereby resisting the tendency of the tubing to rise up the borehole as the sand is being poured in.

The bottom end cap, as shown in FIG. 5, has a long skirt 96, extending upwards, which envelops the compressed-gromments region. Thus the skirt resists any tendency of the CMC tubing to expand, when tho plugs are tightened. The skirt is slit, and is held tight by means of a clamping band 97.

The top end-retainer 80, as shown in FIGS. 4 and 11, is drilled with small holes in respect of those conduits that are to be plugged, and larger holes for the conduits that are to be left open. As mentioned, the long sleeves 86 are placed in the holes that are to be left open. The need for the user to decide beforehand as to which conduits to plug can sometimes be restrictive, and so, in a variation of the top end-retainer, all the holes may be of the same (large) size. Then, the user is provided with some open-conduit inserts, which comprise the sleeves 86, and some plugged-conduit inserts, which comprise shorter, thicker, sleeves, which bring the hole in the end-retainer down to the size to fit the bolts 85. The top-retainer may also alternatively be provided with a long skirt, which contains the compressed-grommets region, in the manner as shown in respect of the bottom end-retainer.

FIG. 13 shows another profile of CMC tubing that may be used. This profile is especially suitable for smaller sizes of tubing (the tubing in FIG. 13 is 1.07" outside diameter), and is advantageous in that all the grommets are the same, i.e all hexagonal. However, the unevenness of the outer wall might cause the extrusion to distort during cooling and curing. Other profiles may also be considered, bearing in mind the need for the internal walls to serve as spokes to keep the outer wall circular, and the tubing un-kinked, during coiling of the tubing for transport. It is not a requirement that there must be a separate central conduit. The compressed-grommet system as described herein may be used with other kinds of multi-conduit tubing, but the continuously-extruded plastic tubing is very highly suitable for down-borehole use, in conjunction with the port structures, plug assemblies, etc. as described herein.

The compressed-grommet system for plug assemblies, as described herein, takes good account of the fact that the CMC tubing is somewhat flexible. Despite the lack of structural rigidity of the tubing, the system can provide the very high reliability of seals that is called for in a borehole-monitoring system, especially if the monitoring results are to be submitted to a tribunal.

The system also lends itself, from a manufacturing standpoint, to the kind of small-batch production run that is usual in the instrumentation field. The system also does not call for any more special skill and care, when it comes to in-the-field preparations and assembly and installation, than is traditionally required with well and borehole monitoring equipment generally.

The mechanically compressed grommets greatly enhance the usefulness of CMC-tubing. Indeed, the uses to which CMC tubing can be put might be severely limited if the conduits could only be sealed by glueing plugs into the conduits.

At the top and bottom of the tubing, the plug assemblies can be mechanically linked together, whereby each plug aids the others in providing a mechanical lock. It should be regarded that the mechanical lock is more difficult to provide than the hydraulic seal: it is a fairly simple matter for the designer to ensure that the grommet makes a perfect hydraulic seal, but it is not so easy to ensure that the plug-assembly is locked against sliding bodily along the conduit when the conduit is pressurised. The system as described herein, however, not only ensures that the top and bottom plug assemblies are very securely locked to the tubing, but also provides that the port plug assemblies are securely locked, by means of the mechanical abutment/engagement of the members 60 against the ends of the aperture.

Achieving the degree of accuracy that is then required for cutting the aperture is made simple, even in an in-the-field context, by the use of the foolproof template-tool. Thus, even at the ports, where all the rest of the conduits, being empty, cannot contribute to the security of the plug assemblies in the conduit, above and below the port, a very reliable provision for mechanically preventing the plugs from moving is easily accomplished.

It is a comparatively easy matter to lock a sealed plug into a rigid tube, of a material that has high friction, and is round. The as-described system provides secure mechanical locks, in the different modes suitable to the different places where these are needed, even though the tubing is not very rigid, the conduits are of a unusual shape, and the friction of the material is very low.

As mentioned, the system lends itself not only to on-site assembly and installation, but to small-batch production. The components that are used in conjunction with the preferred size of the extruded polythene CMT tubing are easily manufactured (it may be noted, for example, that it would be rather difficult to manufacture the hollow bolts if they had to be smaller than ¼" UNC and longer than six or seven cm.) These easily-made components are easily and reliably able to sustain the forces necessary to operate the system.

Figure 14:
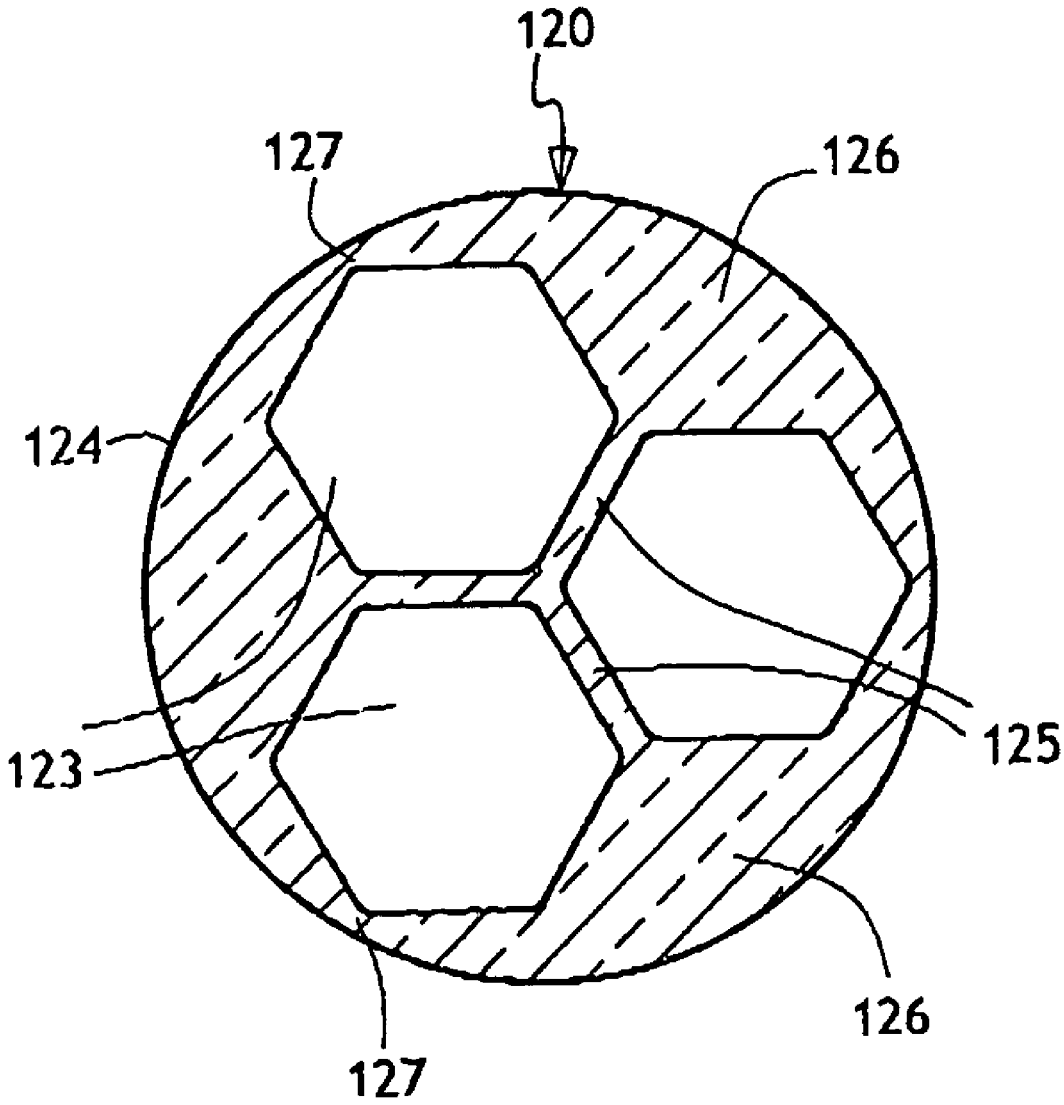
FIG. 14 is a cross-section of another three-channel CMC sampling pipe.

The CMC sampling-pipe 120 shown in cross-section in FIG. 14 is formed as a continuous extrusion of a plastic material, for example polyethylene.

The cross-section includes three hexagonal channels 123. The circumscribing outer form 124 of the sampling-pipe is circular. The invention should not be construed as being limited to the channels being three in number; nor to the channels all being of the same profile; nor to the channels being equi-spaced around the sampling-pipe; nor to the outer form being round.

The channels 123 are separated from each other by the three relatively narrow walls 125. The channels are spaced from the outer form 124 by three relatively thick walls 126. The illustrated profile 124 is 1.09 inches in diameter. The hexagonal channels 123 are 0.41 inches across-flats. The thin walls 125 are 0.04 inches thick.

A borehole sampling-pipe having the illustrated profile can be expected to have the following aspects as to its behaviour and performance.

The invention should not be construed as being limited to the channel 123 being of hexagonal shape. However, the hexagon shape is preferred over e.g a round channel. One of the functions of the channel is to receive a sample-tube having a sample-pump at the bottom end thereof. The sample-tube has to be inserted into the channel 123 from the surface end. If the multi-channel sampling pipe 120, and therefore the channel 123, is e.g hundreds of feet long, it can become quite difficult to insert the sample-tube and sample-pump all the way. The sample-tube and sample-pump are round in profile, and it has been found that they can pass along a very long channel with fewer friction problems if the channel is hexagonal rather than round.

A hexagonal channel of 0.41 inches a/f is adequate for receiving a sample-pump and a sample-tube of the kind that can be lowered to depths of hundreds of feet, having an outer diameter of around 0.3". The above-mentioned lowering difficulties would be encountered if the channel were to be round at a diameter of 0.41 inches; by contrast, if the channels were e.g square, at 0.41 inches a/f, that would be fine from the standpoint of insertability and lowerability of the sample-tube and sample-pump, but square channels would require a larger circumscribing circle 124.

One of the usages to which the multi-channel sampling-pipe 120 may be put is to provide sampling-ports at a number of different depths in the borehole. Each sampling port includes a hole that is cut in one of the (thick) side walls 126. The cut hole connects the outside ground water at that depth to the inside of the appropriate one of the channels 123, whereby a sample of the water can be pumped or otherwise conveyed to the surface for analysis, testing, etc.

The three channels as shown in FIG. 14 would have respective cut holes. Thus, three samples can be conveyed separately to the surface, whereby samples can be drawn from three different depths, as dictated by the respective depths of the three cut holes.

When taking samples, it is often required to plug the channel above and below the sampling port. In that case, the sample is conveyed to the surface through the above-plug. The designer may design the plug structure to be inserted into the channel aperture through the cut hole. Of course, the sampling ports are cut, and plugged, at the appropriate distances along the sampling-pipe, while the sampling-pipe resides at the surface.

Preferably, a below-plug should be provided in respect of each sampling-port. This below-plug might be right at the very bottom of the sampling-pipe, or individual below-plugs might be provided just below the respective cut holes. The portion of the channel below the sampling-port should not simply be left open (because, then, groundwater from the bottom end of the sampling-pipe would enter all the channels, and fill them up to the level as determined by the in-ground pressure head).

A just-below-the-port plug is preferred over a right-at-the-bottom plug. There might be several hundred feet of length of the sampling-pipe below the sampling-port, and a tribunal might question whether some water (or rather, some contaminants) from a lower depth might be leaching through the walls of the sampling-pipe, over that long distance. Placing the below-plug just below the sampling-port eliminates that question.

Whether an above-plug is also provided depends on what parameter is being tested, and on the method of extracting the samples. In many cases, a sample is extracted by lowering a sample-tube, with a self-contained sample-pump attached, down from the surface. In other cases, the above-plug itself complements a structure that is lowered down from the surface, whereby together they make up a complete sample-pump.

The profiles of the channels of the sampling-pipe should be such as to permit the insertion of a sample-tube and sample-pump, but also the profiles should be such as will enable a reliable watertight seal to be made in respect of the below-plug, and of the above-plug if there is one. The profile being non-round means that it is easy to arrange for a screw-thread arrangement to be tightened, when locking and sealing the plug into the channel, in that one component of the plug can be profiled to engage non-rotationally with the profile of the channel, and that component can serve as the nut of the screw-thread arrangement.

After the sampling-pipe has been installed in the borehole, a sample-tube and sample-pump can be lowered down through the channel to the port. Or, the sample-tube and sample-pump can be left permanently installed in the sampling-pipe.

The sampling-pipe 120 is manufactured as one long extrusion. That is to say, if the sampling-pipe is to be used to a depth of five hundred feet in a borehole, the extruded length of the sampling-pipe itself is five hundred feet. The sampling-pipe is transported and delivered to the site packed in a coil. For ease of transport, the coil should preferably be no more than eight or ten feet in diameter. It is required that the extruded profile of the sampling-pipe should be such that the pipe does not tend to buckle or kink when coiled to such a diameter.

It has been found that the profile of FIG. 14 is highly resistant to kinking when coiled. One of the reasons for this resistance is the presence of the three thick walls 126. From the structural standpoint, it may be regarded that each one of the three thick walls 126 is very rigid in itself, and that the thick walls are joined together at their ends by the bridges 127. Thus, although the bridges 127 are relatively flimsy, in themselves, the bridges are merely called upon to act as joints, to join together the very rigid walls 126. Thus, the structure of the profile, as a whole, is basically a very rigid triangle.

In order for the sampling-pipe 120 to kink or buckle, when coiled, the profile itself would have to collapse. The triangulated structure of the profile, as described, is highly resistant to buckling. Furthermore, its resistance remains (almost) the same at all orientations of the sampling-pipe.

One of the criticisms that might be levelled against the profile illustrated in FIG. 14 is that the profile varies a great deal as to the thickness of the extruded material. It is generally regarded as good engineering practice for an extruded profile to be of constant thickness. However, in this case, the problems associated with variations in thickness are of less than the usual concern.

Thus, for example, it can be expected that the outside form 124 will not be an accurately-perfect circle, because the extruded profile has such large thickness variations. But that is not a problem. The one-inch (actually 1.09") size of sampling-pipe is intended to be lowered into boreholes of at least two inches diameter, and is intended to be sealed into the borehole, at the appropriate depths, by the use of inflatable packers or bentonite seals. The packers or seals fill the annular space between the outer form of the sampling-pipe and the borehole wall, whereby a little irregularity in the nominally-circular outer form 124 is of no consequence.

It can also be expected that the density of the extruded material in the middle of the thick walls 126 might not be the same as that in the thin walls 125. However, insofar as there are variations, the material present in the thin-walled areas of the profile are likely to have more integrity than the material at the centre of the thick walls. If the material in the centre of the thick walls should be a little deficient, that does not matter since that material is mainly there simply to provide bulk, to render the thick walls rigid.

Regarding the coilability of CMC tubing having the profile of FIG. 14, it has been found, surprisingly, that the one-inch size of that tubing can be rolled into a coil having a diameter of as little as four or five feet, without any hint of kinking. Thus, a length of such tubing, hundreds of feet long, can be transported to a site in a pick-up truck. One person can lift the coil of tubing down from the truck; and inserting the tubing into the borehole is a simple matter of hand over hand manipulation.

Another very useful size of multi-channel tubing is the 1.7-inch-diameter size. At a tubing diameter of 1.7", the CMC tubing could not be coiled at four or five feet, without danger of kinking, but an eight to ten feet coil is attainable. The importance of ten-feet coilability should not be underestimated. If a long length of continuous tubing, without any joints, can be coiled to less than about ten feet, the tubing can be transported from factory to installation site, still in the one long continuous length, without joints. That is a huge advantage over traditional multi-channel tubing, which was rigid or semi-rigid, and had to be transported in separate lengths, which were joined together on site. From this standpoint, ten feet is about the limit of coilability; if the tubing could be coiled only down to a coil diameter of say fifteen or twenty feet, the coil could not then be simply put on a truck, and then the transportation options are very limited. Again, it has been found that the FIG. 14 profile can be coiled down to about four or five feet in the 1" size, and down to about eight or ten feet in the 1.7" size.

The FIG. 14 profile is so highly resistant to kinking because of the triangulated thick chunky walls. It can be expected that the profiles shown in FIGS. 17,18,19,20 would be able to be coiled to similar small coil diameters, because they also have thick chunky walls arranged in a triangle. While the profiles illustrated herein are not intended as an exhaustive collection, the designer should be mindful of the need to ensure freedom from kinking when the sampling pipe is wrapped in a tight coil. The profile apertures defining the channels should be 60 positioned and dimensioned as to leave walls that are thick and chunky. Delicate, thin-walled profiles are not preferred.

FIG. 15 shows another profile, which includes a bump 128 on the exterior of the profile, which serves to mark the three channels. In fact, some designers prefer not to use a protruding bump to mark the orientation of the channels, because a tribunal might question whether the bump might have compromised the packer seal. In that case, the orientation marker can take the form of e.g a texture embossed into the outside surface of the tubing; the texture can be embossed by, for example, a roller that is applied to the tubing during extrusion, before curing.

FIG. 13 shows another profile of sampling-pipe 129. Here, the profile includes three small channels 130.

These extra channels can be useful, for example, for conveying packer inflation fluid down to the packers, where that is required. Also, the wall thickness of the extruded section in FIG. 13 is much more even and uniform than the extruded wall thickness in FIG. 14, and such evenness makes it easier to achieve regularity of the mechanical properties over the extruded profile.

However, the extra channels 130 can be disadvantageous. If there should be artesian pressure in the borehole, the pressurised liquid can be forced up from the bottom of the borehole to the surface. The individual channels 130 are not suitable to receive an effective plugging mechanism. The artesian problem might be solved by placing a cap over the bottom of the sampling-pipe 129, before insertion, but the difficulty is that the artesian pressure might develop some time after the installation has been done, and the sampling-pipe has been packed in place.

Another disadvantage with the profile of FIG. 13 is that the three thick walls 126 of FIG. 14 are not present in FIG. 13. Thus, the very robust triangulated structural profile of FIG. 14 is not present in FIG. 13. Thus, the diameter of the coils in which long lengths of the sampling-pipe can be packed and transported are likely to be considerably larger than the eight or ten feet as mentioned for FIG. 14; in other words, if the profile of FIG. 13 were to be coiled to the small diameter, the danger of kinking would be too high. (Of course, the danger of coiling-induced kinking, with the profile of FIG. 13, is still tiny compared with the very great danger of kinking when the same diameter of simple cylindrical tubing is coiled.)

The profile of FIG. 16 relieves some of these aspects, but at the expense of reducing the cross-sectional area.

The profile of FIG. 14 is preferred. As mentioned, the inaccuracies and unpredictabilities arising from the uneven-thickness profile are in areas where they can be accommodated.

A major function of the polygonal shape of the channels as described herein is to avoid having small corner-angles in the channels. The smaller the corner-angle, the more the sample-tube might snag and jam in the channel. During the (long) insertion of the sample-tube into the channel, the tendency can arise for the sample-tube to drive itself towards one side of the channel, due to the channel or the tube not being quite straight, and the designer should make sure the tube does not tend to snag or jam in the channel when that happens.

It is recognised that the smaller the corner-angle, the greater the multiplying factor by which the tendency to snag and jam will be exacerbated. For this reason, the channel polygon should have corner-angles of not less than ninety degrees; in other words, the polygon should have be least four-sided. A hexagon shape is preferred. Eight sides would be the practical maximum.

FIGS. 17–22 show other extruded profiles that may be used in the invention. It will be noted that, in FIGS. 13,14,16,20, the three bridges 127 are of short circumferential length, whereas the three bridges 134 in FIGS. 18,19 occupy a larger proportion of the whole circumference. The smaller (i.e shorter) bridge 127 is preferred. The profile of the sampling-pipe is designed to resist buckling, folding, kinking of the profile when the sampling-pipe is wrapped into a tight coil. Where the profile comprises three thick struts arranged in a triangle, that profile is very rigid (and therefore resistant to kinking) even if the bridges themselves are quite flexible (just as, in a triangulated framework, the framework is rigid even though the joints between the struts are pin-joints). However, if the thin flexible bridges are themselves quite long, as in FIGS. 18,19, then those bridges 134 start to become significant struts in their own right—which means that the profile as a whole loses some of its ability to resist kinking.

Figure 18:
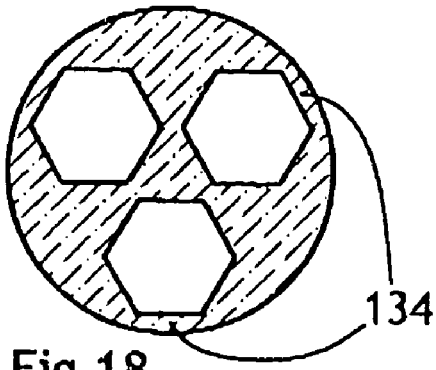
Figure 17:
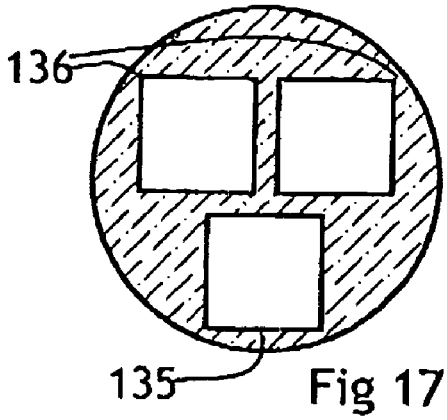
Figure 20:
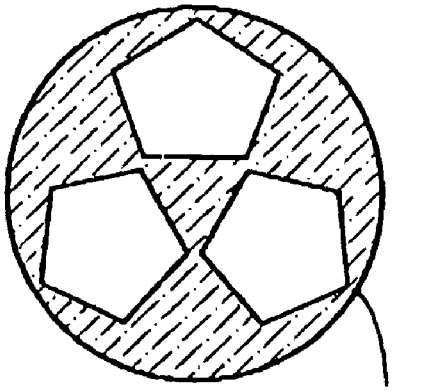
Figure 19:
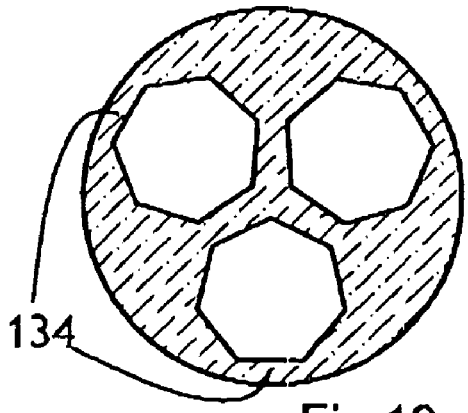
Figure 22:
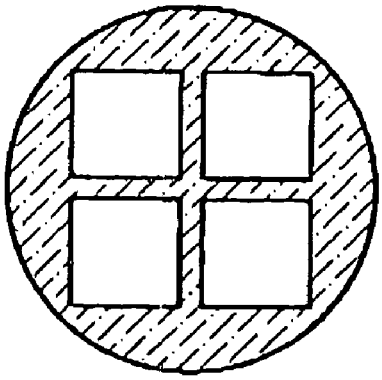
FIGS. 21,22 are cross-sections of four-channel CMC sampling-pipes.
Figure 21:
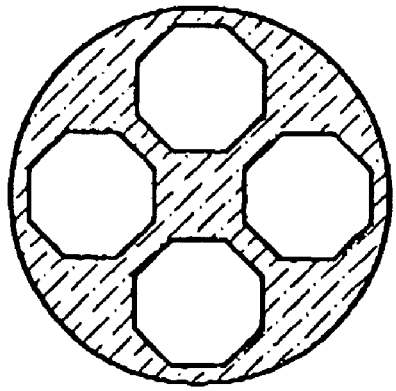

The resistance to kinking of course depends on the weakest link; therefore, the profile of FIG. 17, in which only one 135 of the bridges is long, the other two bridges 136 being short, would have to be classed as a non-preferred long-bridge profile, like FIGS. 18,19.

Sometimes, four or more channels are needed, e.g to enable samples to be taken from four or more depths. The four-channel profiles (FIGS. 21,22) are not triangulated, and therefore not so rigid, and would not be able to be coiled so tightly as the triangulated profiles, but even then the short-bridges-joining-thick-struts arrangement of FIG. 22 should be preferred over the long-bridges arrangement of FIG. 21.

It may be noted that the bridges could not be shorter, circumferentially, than when the channel aperture is so orientated that a radius of the (circular) outer profile, being a radius that passes through the centre of the channel aperture, also passes through the radially outermost one of the corners of the aperture profile. It follows, corollarily, that the bridge could not be longer, circumferentially, than when the channel aperture is so orientated that a radius of the (circular) outer profile, being a radius that passes through the centre of the channel aperture, also passes half-way between two of the corners of the aperture profile.

In determining what profile to extrude, the designer should be mindful of the actual process of extrusion. It is important that the sampling-pipe in the borehole be in one continuous length, preferably without any joints at all. Thus, the pipe has to be extruded in very long lengths (e.g a hundred meters or more).

Generally, the sampling-pipe, after extrusion and curing, will be wrapped into a coil, for storage. One aspect of storage is that, even though the pipe may be fully cured prior to being coiled, still the pipe will tend to take on the curvature of the coil, if left in the coil for a long storage period. Thus, the diameter of the storage coil should be as large as can reasonably be accommodated in the warehouse—and a coil storage diameter of, say, twenty feet is typical. The pipe is wrapped into the tighter (e.g eight or ten foot) coil just prior to transport to the site.

While the spoked profiles as shown are very suitable when used in this manner, it has been found that the triangulated, more chunky configurations are as, or even more, resistant to buckling and kinking when coiled. That is to say: when three thick walls are arranged to form a hollow triangle, the resulting profile can be even more rigid than the thin-radial-spokes type of profile.

The invention claimed is:

1. Multi-channel sampling-pipe, wherein:

the sampling-pipe is suitable for use in conveying samples of water from a borehole in the ground to the surface;

the sampling-pipe is of plastic material, and is an extrusion having a constant cross-sectional profile along its length;

the extruded profile includes N channels, defined by walls of the plastic material;

in the extruded profile, each one of the N channels is totally circumscribed by the walls of plastic material, whereby the N channels are separated and isolated from each other;

each one of the N channels is not circular, but is an M-sided polygon, having M sides that meet at M corners;

each one of the M corners defines a corner-angle that is ninety degrees or greater.

2. Sampling-pipe of claim 1, wherein, in respect of each one of the N channels, the M-sided polygon is a regular polygon, the M sides being all the same length and the M corners being all the same corner-angle.

3. Sampling-pipe of claim 1, wherein the N channels are identical to each other.

4. Sampling-pipe of claim 1, wherein the extruded profile of the sampling-pipe has an outside form, which is at least approximately circular.

5. Sampling-pipe of claim 4, wherein the N channels are pitched equally within the circular outside form of the extruded profile.

6. Sampling-pipe of claim 1, wherein the number N is three or four.

7. Sampling-pipe of claim 1, wherein the number M is four, five, six, seven, or eight.

8. Sampling-pipe of claim 1, wherein, within the extruded profile:

the profile includes N thick-walls of the plastic material, the thick-walls being contiguous with the outside form;

the thick-walls are each of a relatively thick and chunky configuration, to the extent that each thick-wall is inherently sturdy and rigid;

the thick-walls are joined at their ends by N bridge-walls of the plastic material;

the bridge-walls are each of a relatively thin and flexible configuration.

9. Sampling-pipe of claim 8, wherein the number N is three.

10. Sampling-pipe of claim 9, wherein the N thick-walls are triangulated, and the profile is thereby inherently rigid, and is resistant to buckling and collapse.

11. Sampling-pipe of claim 9, wherein the number M is six.

12. Sampling-pipe of claim 8, wherein the profile also includes thin-walls of the plastic material, the thin-walls being arranged as radial spokes.

13. Sampling-pipe of claim 1, wherein:

the extruded profile of the sampling-pipe has an outside form, which is at least approximately circular;

the N channels are identical to each other, and are equi-pitched within the circular outside form of the extruded profile; and each M-sided polygon is regular, the M sides being all the same length and the M corners being all the same corner-angle.

14. Sampling-pipe of claim 13, wherein:

the outside form has an overall-centre;

each polygon has a respective polygon-centre; and in respect of each polygon, a radius from the overall-centre, and passing though the polygon-centre, also passes through, or nearly through, a radially-outermost one of the M corners of the polygon.

15. Sampling-pipe of claim 11, the channels being three regular, equi-pitched hexagons, wherein the extruded profile includes three triangular apertures, located between the hexagons, and spaced therefrom by respective thin walls.

16. Sampling-pipe of claim 1, wherein:

the sampling-pipe lies inserted in a borehole in the ground, and the borehole contains a level of a liquid; and the sampling-pipe includes a sampling-port located at a depth below the level of the liquid, at which a hole through the outside form of the sampling-pipe admit liquid from the borehole into a respective one of the channels.

17. Sampling-pipe of claim 16, wherein the sampling-pipe includes N sampling-ports, at N different depths, in which respective holes through the outside form admit liquid from the borehole into respective ones of the channels.

18. Sampling-pipe of claim 17, wherein the channels include respective below-plugs, located in the channels, below the respective sampling-ports.

19. Sampling-pipe of claim 4, wherein the outside form has a diameter of less than 1.8 inches.

20. Sampling-pipe of claim 19, wherein the outside form has a diameter of less than 1.1 inches.

21. Sampling-pipe of claim 4, wherein the outside form has a diameter of more than one inch.

* * * * *